United States Patent [19]

Tashiro

[11] Patent Number: 4,478,505

[45] Date of Patent: Oct. 23, 1984

[54] DEVELOPING APPARATUS FOR IMPROVED CHARGING OF FLYING TONER

[75] Inventor: Tsuneo Tashiro, Sagamihara, Japan

[73] Assignee: Tokyo Shibaura Denki Kabushiki Kaisha, Kawasaki, Japan

[21] Appl. No.: 422,176

[22] Filed: Sep. 23, 1982

[30] Foreign Application Priority Data

Sep. 30, 1981 [JP] Japan ..... 56-155145
Dec. 26, 1981 [JP] Japan ..... 56-213017

[51] Int. Cl.[3] ..... G03G 15/08

[52] U.S. Cl. ..... 355/3 DD; 355/140; 118/620

[58] Field of Search ..... 355/3 DD, 14 D, 3 R, 355/14 R; 118/620, 638, 647; 96/1 C; 430/120

[56] References Cited

U.S. PATENT DOCUMENTS 3,908,037 9/1975 Bickmore ..... 355/3 DD X
4,007,707 2/1977 Buchan et al. ..... 355/3 DD X
4,194,830 3/1980 Ohnuma et al. ..... 355/3 DD
4,385,829 5/1983 Nakahata et al. ..... 355/3 DD

FOREIGN PATENT DOCUMENTS 56-27158 10/1979 Japan .
56-116060 2/1980 Japan .

*Primary Examiner*—A. C. Prescott
*Attorney, Agent, or Firm*—Cushman, Darby and Cushman

[57] ABSTRACT

In a developing apparatus, a conveyor for conveying developer particles supplied from developer supplying means defines a gap with the surface of a photosensitive body. A developer supplying passage for conveying the developer particles is provided between the developer supplying means and the gap. The developer supplying passage is defined by the conveyor and an electrode plate provided at a predetermined interval with the conveyor. An alternating electric field is applied to the developer supplying passage by an A.C. power source to reciprocate the developer particles between the conveyor and the electrode plate, thereby sufficiently and uniformly charging the developer particles by friction.

15 Claims, 9 Drawing Figures

DEVELOPING APPARATUS FOR IMPROVED CHARGING OF FLYING TONER

BACKGROUND OF THE INVENTION

The present invention relates to a developing apparatus and, more particularly, to a developing apparatus for developing an electrostatic latent image formed on a photosensitive layer of an electronic copying machine.

In general, in a developing apparatus of an electronic copying machine, a developing apparatus of non-contact type which develops a latent image by flying toner particles without direct contact of a toner layer held on a toner holder with a photosensitive member is known.

The conventional developing apparatus of this non-contact type has had the following disadvantages due to the fact that toner is not sufficiently and uniformly charged:

For example, there is disclosed in Japanese Patent Publication No. 9475/1966 a developing apparatus which develops a latent image by approaching a toner holder to a photosensitive layer. In this developing apparatus, since the toner is not uniformly and sufficiently charged, the transfer of the toner from the toner holder to the photosensitive layer is largely affected by the gap between the photosensitive layer and the toner holder, and by the electrostatic force. In other words, when the electrostatic force is excessively strong, the background of a photosensitive layer is contaminated. When the gap is excessively wide, the density of the image on the copy sheet becomes insufficient, or the density of the developed picture is uneven.

Further, there is also disclosed in Japanese Utility Model Laid-Open No. 126856/1974 a developing apparatus which develops an electrostatic latent image by applying electric pulses to the developing space between a toner holder and a photosensitive layer. In this case, toner is not sufficiently and uniformly charged. Accordingly, toner is adhered to the background of a photosensitive layer, thereby contaminating the background of the photosensitive layer. Thus, it cannot obtain a clear image on the copy sheet, or the density of the developed image becomes uneven.

SUMMARY OF THE INVENTION

It is an object of the present invention to provide a developing apparatus which is capable of forming a clear picture image on a photosensitive layer by applying sufficiently and uniformly charging toner as a developer.

According to an aspect of the present invention, there is provided a developing apparatus for developing a latent image by supplying developer particles onto the surface of a photosensitive body comprising: developer supplying means for supplying developer particles; a conveyor for conveying the developer particles supplied from the developer supplying means to a gap between the surface of the photosensitive body and the conveyor via a predetermined developer supply passage; and means for generating a first electric field for applying an alternating electric field to the developer supply passage.

DETAILED DESCRIPTION OF THE PREFERRED EMBODIMENTS

Embodiments of the present invention will now be described in more detail with reference to FIGS. 1 to 9.

Figure 1:
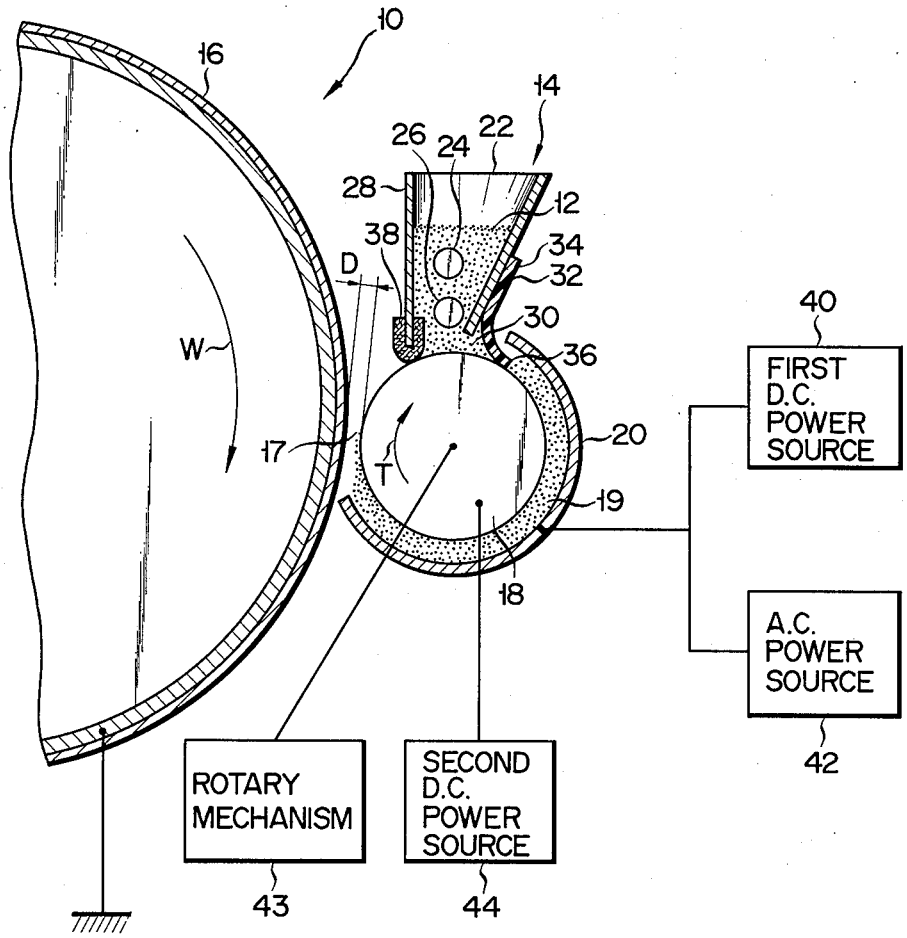
FIG. 1 is a side sectional view schematically showing an embodiment of a developing apparatus according to the present invention.
Figure 2:
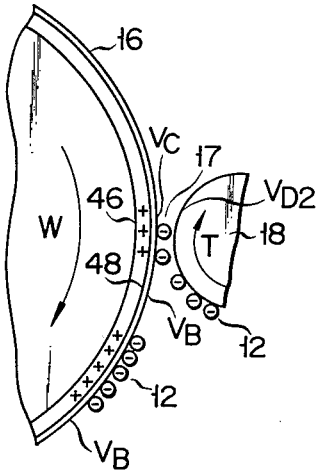
FIG. 2 is a view showing the embodiment of the developing apparatus according to the present invention with respect to the relationship of voltages at various positions of the positive development.
Figure 3:
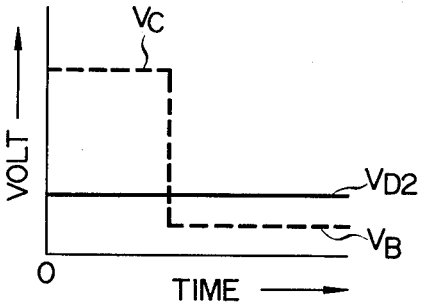
FIG. 3 is a diagram showing the relationship of the voltages with respect to time at the various positions shown in FIG. 2.

Referring now to FIGS. 1 to 3, an embodiment of the present invention will be described in detail.

As shown in FIG. 1, a developing apparatus 10 constructed according to the embodiment of the present invention generally comprises a hopper 14 for supplying toner 12, a roller 18 for conveying the toner 12 supplied from the hopper 14 to a developing space 17 facing the surface of a photosensitive layer 16 and an electrode plate 20 which defines together with the roller 18 a conveying space 19 for conveying the toner 12. Feeding screws 24, 26 are installed in the hopper 14 for uniformly scattering the toner supplied from an opening 12 formed at the top thereof. The toner 12 supplied to the hopper 14 is, as is well known insulating and non-magnetic. This toner 12 is charged in a polarity opposite to that of a photosensitive surface in the case of positive development and is charged in the same polarity as the photosensitive surface in the case of negative development. A supply port 30 for supplying the toner 12 is provided on the roller 18 side in the hopper 14. One end 34 of an elastic blade 32 is secured to the conveying space 19 side of a housing 28. The free end of the blade 32 is contacted on the surface of the roller 18 along the rotating direction T of the roller 18. This blade 32 is formed of Teflon rubber, serves to urge the toner 12 onto the surface of the roller 18 and to press the toner 12 on the surface of the roller 18, thereby complementarily charging the toner 12 by friction. A velveteen cloth 38 is provided on the developing space 17 side of the hopper 14 to contact with the surface of the roller 18. This cloth 38 lightly contacts the surface of the roller 18 so as not to scrape off the toner remaining on the roller 18 and not to drop the toner 12 in the vicinity of the supply port 30 to the photosensitive layer 16 side.

The electrode plate 20 is installed along the surface of the roller 18 and spaced a predetermined interval from the surface of the roller 18 so as to define the conveying space 19 for conveying the toner while charging the toner 12 by friction at the side far from the developing space 17 of the roller 18. This electrode plate 20 is installed from near the free end 36 of the blade 32 to the developing space 17. To the electrode plate 20 are connected a first D.C. power source 40 for applying a D.C. voltage $V_{D1}$ and an A.C. power source 42 for applying A.C. voltage $V_A$. As one example, the A.C. voltage applied from the A.C. power source 42 to the electrode plate 20 is set to 1000 V and its frequency is set to 1 kHz.

The surface of the roller 18 is formed of conductive aluminum which is sandblasted to remove the smoothness of its surface. As a result, the surface of the roller 18 is roughened, the toner 12 is supported on the rough surface of the roller 18 and is thus conveyed by the rotation of the roller 18. In the developing space 17, a rotary mechanism 43 for rotating the roller in the reverse direction to the rotating diretion of the photosensitive member and hence in the direction T is connected to the roller 18. A second D.C. power source 44 for applying a D.C. voltage $V_{D2}$ is connected to the roller 18. The D.C. voltage $V_{D2}$ is set substantially equal to the D.C. voltage $V_{D1}$ applied to the electrode plate 20. A predetermined interval D is spaced between the surface of the photosensitive layer 16 and the roller 18 to define the developing space 17. In the embodiment described above, the interval D of the developing space is set to approximately 0.2 to 0.5 mm.

The operation of the developing apparatus of the first embodiment thus constructed according to the present invention will now be described.

The toner 12 supplied from the hopper 14 to the surface of the roller 18 is moved to the elastic blade 32 by rotating the roller 18 in the direction of an arrow T. The free end 36 of the blade 32 causes the toner 12 to be frictionally contacted to the roller 18. As a consequence, the toner 12 is charged by friction with the blade 32. However, the charge of the toner 12 at this time is small or only a part of the toner 12 is charged.

On the other hand, a photosensitive drum (not shown) having the surface of the photosensitive layer 16 formed with an electrostatic latent image is rotated along the direction of an arrow W.

The toner 12 thus partly charged by friction with the blade 32 is, when arriving at the conveying space 19, reciprocated between the roller 18 and the electrode plate 20 since an alternating electric field is formed in the conveying space 19 by the A.C. voltage applied to the electrode plate 20. As a result, the toner 12 is sufficiently and uniformly charged by friction while passing the conveying space 19. When the toner 12 has passed the conveying space 19, the toner 12 supported on the surface of the roller 18 reaches the developing space 17.

In the developing space 17, the surface of the photosensitive layer 16 and the surface of the roller 18 are rotated in the directions of arrows W and T, respectively, to oppose each other. When the toner 12 supported in the sufficiently charged state on the surface of the roller 18 reaches the developing space 17, the toner 12 will face the surface of the photosensitive layer 16 formed with the electrostatic latent image. Thus, the toner 12 is transferred from the surface of the roller 18 to the surface of the photosensitive layer 16, and is thus adhered to the surface of the photosensitive layer 16, thereby developing the electrostatic latent image formed on the surface of the photosensitive layer 16.

The relationship between the voltage $V_C$ of the electrostatic latent image formed on the surface of the photosensitive layer 16, the voltage $V_B$ of the part (background) not formed with the electrostatic latent image on the surface of the photosensitive layer 16, and the D.C. voltage $V_{D2}$ applied to the roller 18 is shown in FIGS. 2 and 3 in the case of the positive development and hence, the toner of negative polarity. FIG. 3 is a graph showing the relationship between the respective voltages, wherein the voltage is indicated in ordinate and time is indicated in abscissa. As evident from this graph, the voltage $V_{D2}$ applied to the roller 18 is set between the voltage $V_C$ of the electrostatic latent image on the surface of the photosensitive layer 16 and the voltage $V_B$ of the background 48, and is set to a voltage slightly higher than the voltage $V_B$ of the background 48.

As a result, the toner held by the roller 18 and arriving at the developing space 17 is not attracted to the background voltage lower than the voltage $V_{D2}$ of the roller 18 but is attracted to the electrostatic latent image $V_C$, which is higher than the voltage $V_{D2}$ of the roller 18 to be adhered thereto.

According to this first embodiment of the present invention, toner 12 is reciprocated in the conveying space, and is accordingly sufficiently and uniformly charged by friction. As a consequence, the toner can adhere to the surface of the photosensitive layer 16 in response to the voltage of the electrostatic latent image formed on the surface of the photosensitive layer. Further, the toner does not adhere to the background which is not formed with the electrostatic latent image. In other words, according to this first embodiment of the present invention, a clear picture image can be formed.

Also according to the first embodiment of the present invention, since the toner is sufficiently and uniformly charged, a clear picture image can be formed even if the developing space and, hence, the interval between the surface of the photosensitive layer and the surface of the roller has a relatively wide allowable range. That is, since the toner is sufficiently charged, the toner is not largely affected by the intensity of the electric field formed in the developing space. Therefore, the toner does not adhere to the background due to the large intensity of the electric field in the developing space not to cause contamination of the background, and the toner can uniformly adhere to the electrostatic latent image even if the intensity of the electric field in the developing space is small.

Figure 4:
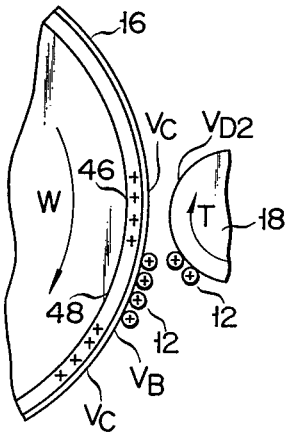
FIG. 4 is a view showing the embodiment of the developing apparatus according to the present invention with respect to the relationship of voltages at various positions of the negative development.
Figure 5:
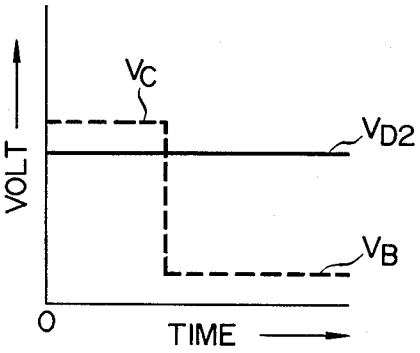
FIG. 5 is a diagram showing the relationship of the voltages with respect to time at the various positions in FIG. 4.

The negative development in this first embodiment will now be described with reference to FIGS. 4 and 5. The toner used for the negative development is positive in polarity. The relationship between the respective voltages of this case is shown in FIGS. 4 and 5. FIG. 5 shows the voltage in the ordinate and time in abscissa. As evident from FIG. 5, the D.C. voltage $V_{D2}$ applied to the roller 18 is set between the voltage $V_C$ of the electrostatic latent image on the surface of the photosensitive layer 16 and the voltage $V_B$ of the part (background) not formed with the electrostatic latent image in the case of the negative development in the first embodiment of the present invention, and is slightly lower than the voltage $V_C$ of the electrostatic latent image.

In the negative development, the same effects and advantages as those in the positive development can be provided. In other words, the toner can be sufficiently and uniformly charged; therefore, a clear picture image can be obtained.

Another preferred embodiment of the present invention will now be described with reference to FIGS. 6 to 9.

Figure 6:
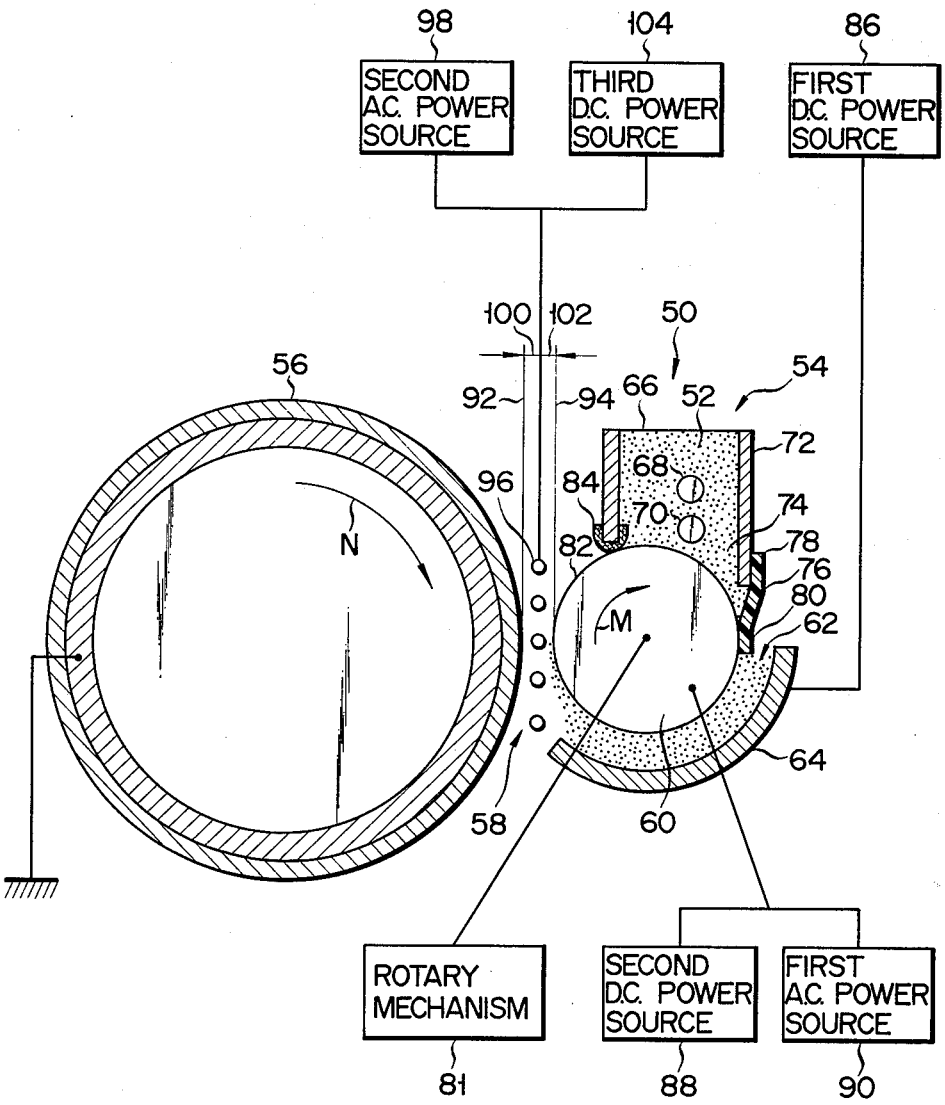
FIG. 6 is a side sectional view schematically showing another embodiment of the developing apparatus according to the present invention.

As shown in FIG. 6, a developing apparatus according to another embodiment of the present invention generally comprises a hopper 54 for supplying toner 52, a roller 60 for conveying the toner 52 supplied from the hopper 54 to the developing space 58 faced with the surface of a photosensitive layer 56, and an electrode plate 64 which defines together with the roller 60 a conveying space 62 for conveying the toner 52 from the hopper 54 to the developing space 58. Feeding screws 68, 70 are installed in the hopper 14 for uniformly scattering the toner 52 supplied from an opening 66 formed at the top thereof. The toner 52 supplied to the hopper 54 is insulating and nonmagnetic. In the embodiment described above, the toner 52 is charged in a polarity opposite to that of a photosensitive surface in the case of positive development, and is charged in the same polarity as the photosensitive surface in the case of negative development. A supply port 74 for supplying the toner 52 is defined in a housing 72 of the hopper 54. One end 78 of an elastic blade 76 is secured to the conveying space 62 side of the housing 72. The free end 80 of the blade 76 is contacted with the surface 82 of the roller 60 along the rotating direction M of the roller 60. This blade 76, formed of Teflon rubber, contacts the toner 52 to the surface 82 of the roller 60, and charges the toner 52 by friction. A velveteen cloth 84 is provided at the developing space 58 side of the hopper 54 to contact the surface 82 of the roller 60. This cloth 84 lightly contacts the surface of the roller 60 so as not to scrape off the toner 52 remaining on the surface 82 of the roller 60 and not to drop the toner 52 in the vicinity of the supply port 74 to the surface 56 side of the photosensitive layer.

The conveying space 58 for conveying the toner while charging the toner by friction is formed at the side far from the developing space 58 of the roller 60, and is installed with the electrode plate 64 at a predetermined interval from the surface 82 of the roller 60 along the surface of the roller 60 to define the conveying space 58. This electrode plate 64 is installed from the vicinity of the free end 80 of the blade 76 over to the developing space 58. A first D.C. power source 86 for applying D.C. voltage $V_{D1}$ is connected to the elctrode plate 64.

A second D.C. power source 88 for applying a voltage $V_{D2}$ equal to the voltage $V_{D1}$ applied to the electrode plate 64 is connected to the roller 60. Further, a first A.C. power source 90 for applying an A.C. voltage $V_{A1}$ is connected to the roller 60. The voltage $V_{A1}$ is, for example, approx. 1 kHz, A.C. 2900 volts and the voltage $V_{D2}$ is approx. 1000 volts. The roller 60 is formed of conductive aluminum. The roller 60 is connected to a rotary mechanism 81 for rotating the roller 60 in a direction M.

The developing space 58 is formed at the end of the conveying space 62. This developing space 58 is defined by the surface of the photosensitive layer 56 and the surface 82 of the roller 60. In the developing space 58 are installed grid 96 in parallel with the first tangential line 92 of the surface of the photosensitive layer 56 and the second tangential line 94 of the surface 82 of the roller 60 extending in parallel with each other. The grid 96 divides the developing space 58 into first and second gaps 100 and 102. The first gap 100 is defined by the grid and the first tangential line 92, and has a predetermined distance $L_1$. The second gap 102 is defined by the grid 96 and the second tangential line 94, and has a predetermined distance $L_2$. The grid 96 is connected to a second power source 98 for applying the voltage $V_{A2}$. This voltage $V_{A2}$ has the same phase as the voltage $V_{A1}$ applied to the roller 60, but is set to a voltage slightly lower than the voltage $V_{A1}$. In other words, the A.C. voltage $V_{A2}$ of the grid 96 is set to produce a relatively low voltage between the grid 96 and the roller 60. Further, the grid 96 is connected to a third D.C. power source 104 for applying a D.C. voltage $V_{D3}$. The voltage $V_{D3}$ applied to the grid 96 is set substantially equal to the voltage $V_{D1}$ applied to the electrode and to the voltage $V_{D2}$ applied to the roller.

The operation of the second embodiment of the present invention will now be described.

As shown in FIG. 6, the toner 52 supplied from the hopper 54 to the surface 82 of the roller 60 is moved to the blade 76 by rotating the roller 60 in the direction of an arrow M. The free end 80 of the blade 76 causes the toner 52 to be frictionally contacted to the roller 60. As a consequence, the toner 52 is thus charged by friction. However, the charge in the toner 52 is small or only part of the toner 52 is charged.

On the other hand, the photosensitive member having the surface 56 of the photosensitive layer formed with the electrostatic latent image is rotated along the direction of an arrow N.

Thus, the toner 52, partly charged by friction with the blade 76, reaches the conveying space 62. In the conveying space 62, an alternating electric field is formed by the A.C. voltage applied to the roller 60, and the toner 52 is accordingly reciprocated between the roller 60 and the electrode 64. As a result, the toner 52 is sufficiently charged by friction while passing the conveying space 62. Then, the toner 52 arrives at the developing space 58 after passing the conveying space 62.

The roller 60 is rotated by the rotary mechanism 81 in the rotating direction M opposite to the rotating direction N of the photosensitive body in the developing space 58.

The operation of the toner 52 in the developing space 58 will now be described in more detail with reference to FIGS. 7 to 9.

Figure 7:
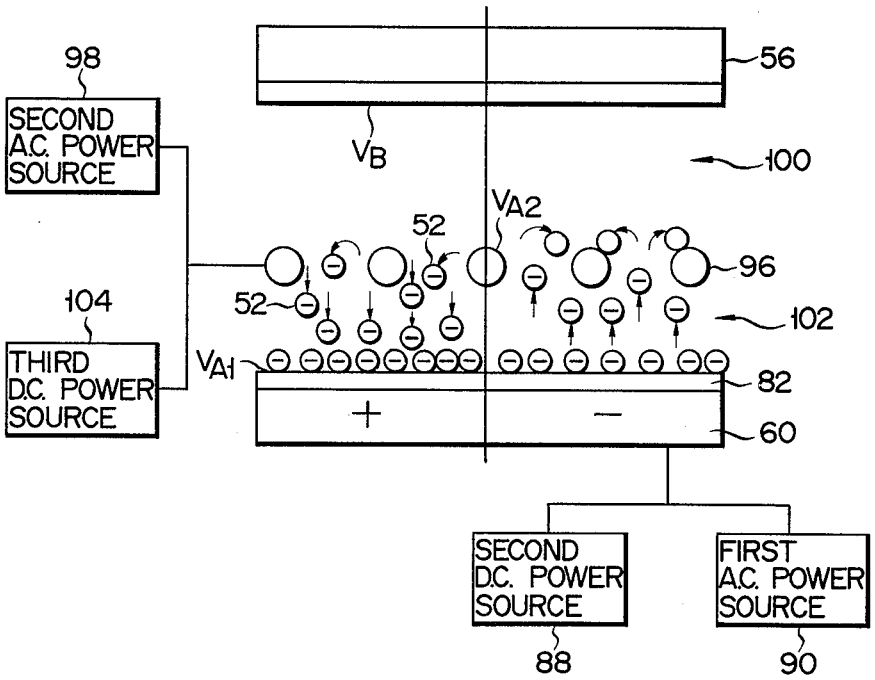
FIGS. 7 and 8 are views showing developing space in FIG. 6, illustrating the motion of toner in the case of positive development.

As shown in FIG. 7, when the surface of the photosensitive layer 56 which is not formed with the electrostatic latent image is disposed at the developing space 58, the toner 52 is reciprocated in the gap 100 between the grid 96 and the surface of the roller 60. In other words, an alternating electric field is produced in the gap $L_1$ due to the potential difference between the A.C. voltage $V_{A1}$ applied to the roller 60 and the voltage A.C. $V_{A2}$ applied to the grid 96. The intensity of the alternating electric field is indicated by $(V_{A1}-V_{A2})/L_1$. Similarly, an alternating electric field is also produced in the gap $L_2$ between the surface of the photosensitive layer 56 and the grid 96 due to the potential difference between the voltage $V_{A2}$ applied to the grid 96 and the surface of the photosensitive layer 56. The intensity of the alternating electric field is indicated by $V_{A2}/L_2$. However, the electric fields in the gaps 100 and 102 are maintained in the relationship represented by the following formula by setting the distances $L_1$, $L_2$ or the voltages $V_{A1}$, $V_{A2}$:

$$|V_{A1}-V_{A2}|/L_1<|V_{A2}|/L_2$$

Accordingly, the toner 52 is reciprocated only in the gap 100 having a large electric field. Thus, the toner 52 is maintained in the power cloud state.

Figure 8:
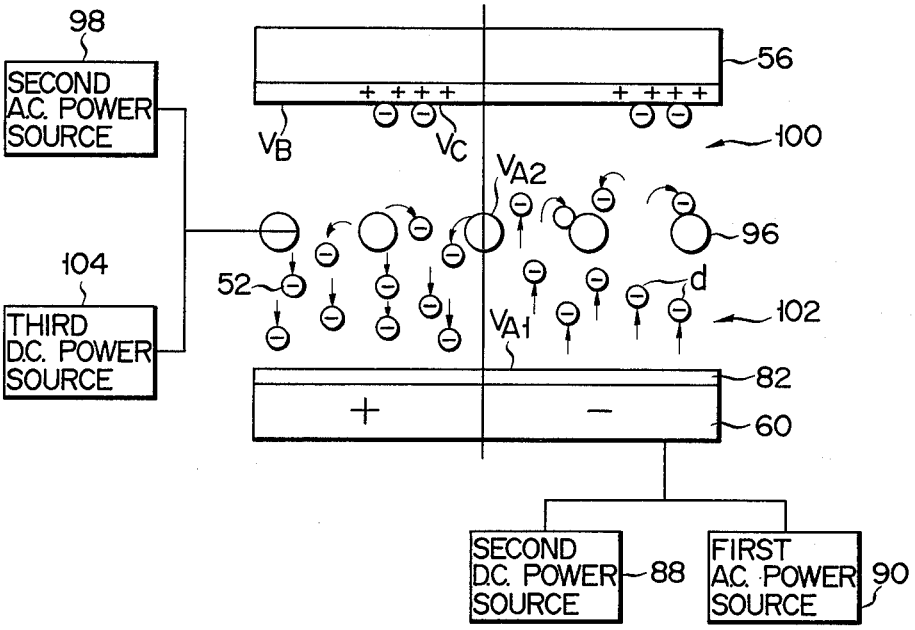

In FIG. 8, the surface of the photosensitive layer 56 which is formed with the electrostatic latent image has arrived at the developing space 58 by the rotation of the photosensitive member. When a positive voltage is applied to the roller 60, as compared with the voltage of the grid 96 (indicated in the left half in FIG. 8), i.e., when the voltage is maintained at the period of time between $t_0$ and $t_1$ in FIG. 9, the toner 52 is moved toward the roller 60 side. Accordingly, the toner 52 does not adhere to the surface of the photosensitive layer at this time.

Figure 9:
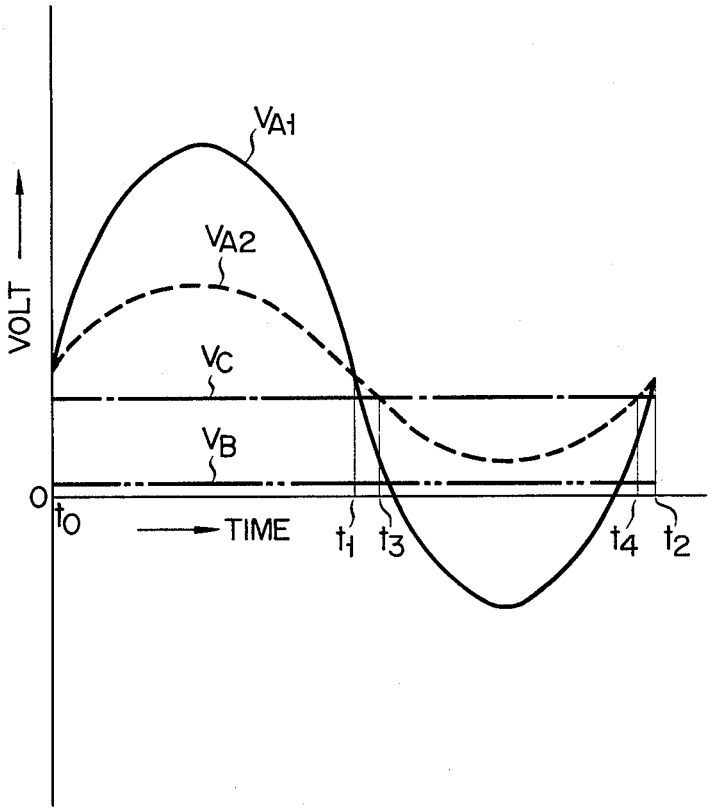
FIG. 9 is a diagram showing the relationship of the voltages at various positions shown in FIGS. 7 and 8.

When the roller 60 is applied with the voltage being minus as compared with the voltage of the grid 96 (indicated in the right half in FIG. 8), i.e., when the voltage is maintained at the period of time between $t_1$ and $t_2$ in FIG. 9, the toner 52 is moved from the roller 60 side toward the grid 96. Then, when the voltage $V_{A2}$ of the grid 96 is minus as compared with the voltage $V_C$ formed as the electrostatic latent image on the surface of the photosensitive layer 56, i.e., when the voltage is maintained at the period of time between $t_3$ and $t_4$ in FIG. 9, the toner 52 floating in the vicinity of the grid 96 is moved toward the electrostatic latent image, and the toner 52 is adhered to the electrostatic latent image. At this time, as shown in FIG. 9, the voltage $V_{A2}$ of the grid 96 is set to a voltage larger than the voltage of the background (the part not formed with the electrostatic latent image) of the surface of the photosensitive layer 56. Accordingly, the toner 52 should not adhere to the background.

Even if the toner does adhere to the background, the toner adhered to the background is moved toward the grid 96 when the alternating electric field in the developing space again becomes the state between $t_0$ and $t_1$. In other words, since the voltage of the grid 96 is much larger than the voltage $V_B$ of the background during the period of time between $t_0$ and $t_1$, the toner 52 adhered to the background is attracted to the grid 96. However, as evident from the above description, the toner 52 which has adhered to the electrostatic latent image at this time has a relatively strong electrostatic force to be adhered to the surface of the photosensitive layer 56, and the toner is not accordingly returned to the grid 96 side.

The electrostatic latent image is developed in the developing space by the repetition of the abovedescribed operations.

According to the second embodiment of the present invention, since the background is not contaminated, a clear picture image can be obtained.

According to the second embodiment of the present invention, the toner 52 is floated in the powder cloud state on the imaginary surface formed between the grids and is not affected by the physical or electric restrictions, and the developing can be accordingly performed with greater speed.

As a consequence, the developing apparatus according to the present invention can sufficiently and uniformly charge the toner; therefore, a clear picture image can be obtained.

What is claimed is:

1. A developing apparatus for developing the surface of a photosensitive body by supplying developer particles thereto comprising:

developer supplying means for supplying developer particles;

a conveyor for conveying developer particles supplied from the developer supplying means to a gap between the surface of the photosensitive body and the conveyor via a developer supplying passage defined between the conveyor and an electrode which faces the conveyor; and means for providing a first alternating electric field to the developer supplying passage whereby the developer particles strike against the conveyor and the electrode to be fully charged by friction.

2. An apparatus according to claim 1, wherein said developer supplying means comprises a member for agitating the developer particles in said developer supplying means.

3. An apparatus according to claim 1, wherein said developer supplying means comprises a blade for complementarily charging by friction the developer particles supplied to the developer supplying passage by frictionally contacting the developer particles to said conveyor.

4. An apparatus according to claim 3, wherein said blade is formed of PTFE rubber.

5. An apparatus according to claim 1, wherein said conveyor comprises a cylindrical roller rotatable in one direction around the rotary axis.

6. An apoparatus according to claim 5, wherein said conveyor comprises a rotary mechanism for rotating the cylindrical roller.

7. An appratus according to claim 6, wherein said cylindrical roller has a rough surface.

8. An apparatus according to claim 7, wherein said cylindrical roller is formed of conductive aluminum.

9. An apparatus according to claim 8, wherein said first electric field generating means comprises an A.C. power source for applying an A.C. voltage to the electrode plate.

10. An apparatus according to claim 9, wherein said first electric field generating means comprises a first D.C. power source for applying a D.C. voltage to the electrode plate and a second D.C. power source for applying a D.C. voltage equal to the voltage applied from said first power source to the cylindrical roller.

11. An apparatus according to claim 8, wherein said apparatus comprises a grid provided in the gap and applied with a voltage.

12. An apparatus according to claim 11, wherein said apparatus further comprises means for generating a second electric field for applying an alternating electric field to the gap.

13. An apparatus according to claim 12, wherein said first electric field generating means comprises a first D.C. power source for applying a D.C. voltage to the electrode plate, a second D.C. power source for applying a D.C. voltage equal to the voltage applied to the electrode plate to said conveyor, and a first A.C. power source for applying an A.C. voltage to the cylindrical roller, said second electric field generating means comprises a second A.C. power source for applying an A.C. voltage to the grid, and a third D.C. power source for applying a D.C. voltage equal to the voltage applied from said second D.C. power source to the grid.

14. An apparatus according to claim 13, wherein said second A.C. power source applies a A.C. voltage lower than the A.C. voltage supplied from the first A.C. power source, and the same phase as said first A.C. power source.

15. An apparatus according to claim 14, wherein the following relationship is set between $V_1$ and $V_2$ when the voltage applied from the first A.C. power source is represented by $V_1$ and the voltage applied from the second A.C. power source is represented by $V_2$:

$$|V_2|/L_1 < |V_1 - V_2|/L_2$$

where $L_1$ is the distance between the grid and the cylindrical roller and $L_2$ is the distance between the surface of the photosensitive member and the grid.

* * * * *